US009175572B2

(12) United States Patent
McMurray et al.

(10) Patent No.: US 9,175,572 B2
(45) Date of Patent: Nov. 3, 2015

(54) TURBOMACHINE BLADE MOUNTING SYSTEM

(75) Inventors: Timothy Scott McMurray, Fultonville, NY (US); Thomas Joseph Farineau, Schoharie, NY (US)

(73) Assignee: General Electric Company, Schenectady, NY (US)

( * ) Notice: Subject to any disclaimer, the term of this patent is extended or adjusted under 35 U.S.C. 154(b) by 728 days.

(21) Appl. No.: 13/448,238

(22) Filed: Apr. 16, 2012

(65) Prior Publication Data

US 2013/0272885 A1 Oct. 17, 2013

(51) Int. Cl.
*F01D 5/14* (2006.01)
*F01D 5/30* (2006.01)

(52) U.S. Cl.
CPC ..... *F01D 5/3038* (2013.01); *F01D 5/147* (2013.01)

(58) Field of Classification Search
CPC ..... F01D 5/3023; F01D 5/303; F01D 5/3038
USPC ..... 416/204 R, 204 A, 215, 219 R, 220 R, 416/248
See application file for complete search history.

(56) References Cited

U.S. PATENT DOCUMENTS

| | | | | |
|---|---|---|---|---|
| 3,292,900 | A * | 12/1966 | Pettersen | 416/218 |
| 4,094,615 | A * | 6/1978 | Glenn | 416/215 |
| 4,684,325 | A * | 8/1987 | Arnold | 416/215 |
| 6,030,178 | A | 2/2000 | Caruso | |
| 6,619,924 | B2 * | 9/2003 | Miller | 416/220 R |
| 6,647,602 | B2 * | 11/2003 | Bachofner et al. | 29/23.51 |
| 7,972,113 | B1 * | 7/2011 | Davies | 416/214 A |
| 8,727,730 | B2 * | 5/2014 | Liotta et al. | 416/193 A |
| 8,740,573 | B2 * | 6/2014 | Delvaux et al. | 416/248 |

* cited by examiner

*Primary Examiner* — Edward Look
*Assistant Examiner* — Justin Seabe
(74) *Attorney, Agent, or Firm* — Fletcher Yoder, P.C.

(57) ABSTRACT

Embodiments of the present disclosure include a system having a turbine blade segment having a blade and a mounting segment coupled to the blade, wherein the mounting segment has a multi-piece assembly configured to mount in a radial direction into a slot of a turbomachine rotor.

6 Claims, 6 Drawing Sheets

TURBOMACHINE BLADE MOUNTING SYSTEM

BACKGROUND OF THE INVENTION

The subject matter disclosed herein relates to turbomachines, and, more particularly, to mounting systems for attaching turbomachine blades to a turbomachine rotor.

Turbomachines include compressors and turbines, such as gas turbines, steam turbines, and hydro turbines. Generally, turbomachines include a rotor, which may be a shaft or drum, which support turbomachine blades. For example, the turbomachine blades may be attached to the rotor by a mounting segment, which mates with a slot in the rotor. Unfortunately, the slot may not permit direct insertion into the slot due to retention features of the one-piece mounting segment and the slot. For example, the one-piece mounting segment may include lateral hooks, which cannot pass into the slot in a radial direction. As a result, the slot requires an assembly gate, such as an enlarged opening, configured to receive the mounting segments during turbomachine blade installation. Unfortunately, assembly gates can increase costs, create stress concentrations in the turbomachine rotor, and prolong turbine start times.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbomachine blade segment having a blade and a mounting segment coupled to the blade, wherein the mounting segment has a multi-piece assembly configured to mount in a radial direction into a slot of a turbomachine rotor.

In a second embodiment, a system includes a turbomachine blade mounting segment having first and second configurations, wherein the first configuration is configured to insert in a radial direction into a slot of a turbomachine rotor, and the second configuration is configured to expand relative to the first configuration to retain the turbomachine blade mounting segment in the slot.

In a third embodiment, a system includes a first turbomachine blade mounting segment configured to couple a first turbomachine blade to a turbomachine rotor and a second turbomachine blade mounting segment configured to couple a second turbomachine blade to the turbomachine rotor. Additionally, the first and second turbomachine blade mounting segments are configured to insert in a radial direction into a slot of the turbomachine rotor, and then expand in the slot.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
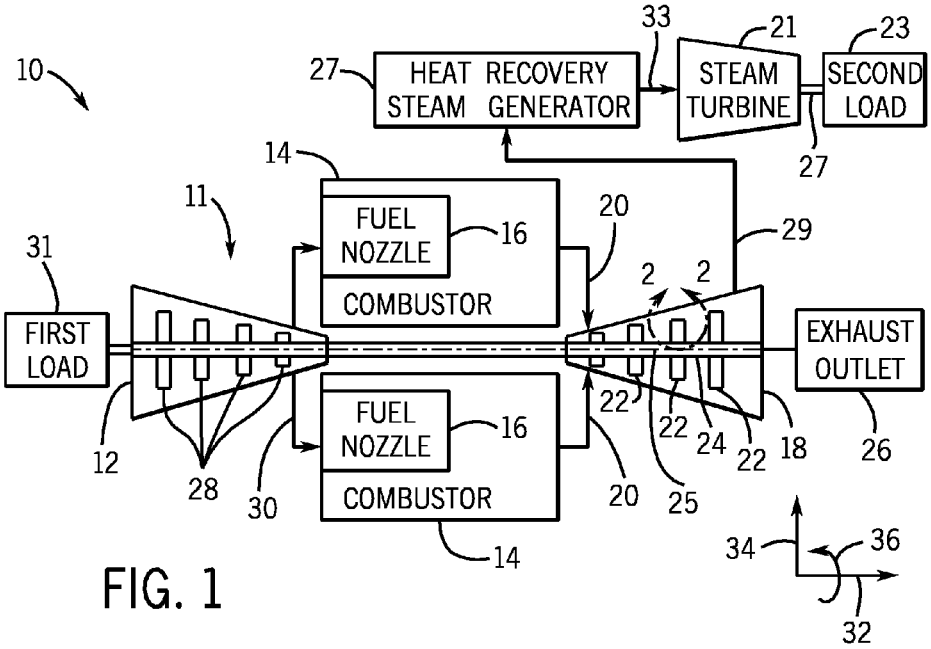
FIG. 1 is a schematic of an embodiment of a combined cycle power generation system having a gas turbine system, a steam turbine, and a heat recovery steam generation (HRSG) system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements.

The terms "comprising," "including," and "having" are intended to be inclusive and mean that there may be additional elements other than the listed elements.

The disclosed embodiments include a turbomachine blade mounting segment (e.g., a first dovetail portion of a dovetail joint) for coupling a turbomachine blade to a drum rotor of a turbomachine, wherein the mounting segment (e.g., a first dovetail portion of a dovetail joint) is configured to mount the turbomachine blade to the rotor or drum without an assembly gate. For example, the mounting segment (e.g., a first dovetail portion of a dovetail joint) may be configured to engage with a retaining slot or recess (e.g., a second dovetail portion of a dovetail joint) of the turbomachine drum or rotor. In certain embodiments, the mounting segment (e.g., a first dovetail portion of a dovetail joint) may be configured to insert radially into the retaining slot or recess (e.g., a second dovetail portion of a dovetail joint) and subsequently rotate within the retaining slot or recess to engage retention features (e.g., hooks). Upon rotation, lateral extensions or hooks of the mounting segment (e.g., a first dovetail portion of a dovetail joint) may engage with retaining ledges of the retaining slot or recess (e.g., a second dovetail portion of a dovetail joint), thereby securing the mounting segment (e.g., a first dovetail portion of a dovetail joint) within the retaining slot or recess (e.g., a second dovetail portion of a dovetail joint). In other embodiments, the mounting segment (e.g., a first dovetail portion of a dovetail joint) may have a segmented or multipiece configuration. For example, multiple pieces of a mounting segment (e.g., a first dovetail portion of a dovetail joint) may be inserted into the retaining slot or recess (e.g., a second dovetail portion of a dovetail joint) of the turbomachine drum or rotor individually. Furthermore, the multiple pieces of the mounting segment (e.g., a first dovetail portion of a dovetail joint) may be coupled to one another by an additional piece of the mounting segment once they are positioned within the retaining slot or recess (e.g., a second dovetail portion of a dovetail joint) of the turbomachine. While the embodiments disclosed below are described in the context of a turbine (e.g., steam, water, or gas turbine), it is important to note that the disclosed mounting segments (e.g., first dovetail portions of dovetail joints) may be used with other turbomachines, such as compressors.

Turning now to the drawings, FIG. 1 is a schematic block diagram of an embodiment of a combined cycle system 10 having various turbomachines that are equipped with improved blade mounting systems (e.g., dovetail joints). Specifically, the turbomachines include turbomachine blades with improved mounting segments (e.g., a first dovetail portion of a dovetail joint), which may be couple to a slot or recess (e.g., a second dovetail portion of a dovetail joint) or a rotor in a radial direction without requiring an assembly gate (e.g., enlarged opening). As shown, the combined cycle system 10 includes a gas turbine system 11 having a compressor 12, combustors 14 having fuel nozzles 16, and a gas turbine 18. The fuel nozzles 16 route a liquid fuel and/or gas fuel, such as natural gas or syngas, into the combustors 14. The combustors 14 ignite and combust a fuel-air mixture, and then pass hot pressurized combustion gases 20 (e.g., exhaust) into the gas turbine 18. The turbine blades 22 are coupled to a rotor 24, which is also coupled to several other components throughout the combined cycle system 10, as illustrated. For example, the turbine blades 22 may be coupled to the rotor 24 with improved mounting segments, as discussed below. As the combustion gases 20 pass through the turbine blades 22 in the gas turbine 18, the gas turbine 18 is driven into rotation, which causes the rotor 24 to rotate along a rotational axis 25. Eventually, the combustion gases 20 exit the gas turbine 18 via an exhaust outlet 26 (e.g., exhaust duct, exhaust stack, silencer, etc.).

In the illustrated embodiment, the compressor 12 includes compressor blades 28. The compressor blades 28 within the compressor 12 are also coupled to the rotor 24 (e.g., with improved mounting segments), and rotate as the rotor 24 is driven into rotation by the gas turbine 18, as described above. As the compressor blades 28 rotate within the compressor 12, the compressor blades 28 compress air from an air intake into pressurized air 30, which is routed to the combustors 14, the fuel nozzles 16, and other portions of the combined cycle system 10. The fuel nozzles 16 then mix the pressurized air and fuel to produce a suitable fuel-air mixture, which combusts in the combustors 14 to generate the combustion gases 20 to drive the turbine 18. Further, the rotor 24 may be coupled to a first load 31, which may be powered via rotation of the rotor 24. For example, the first load 31 may be any suitable device that may generate power via the rotational output of the combined cycle system 10, such as a power generation plant or an external mechanical load. For instance, the first load 31 may include an electrical generator, a propeller of an airplane, and so forth.

The system 10 also includes a steam turbine 21 for driving a second load 23 (e.g., via rotation of a shaft 27). The second load 23 may also be an electrical generator for generating electrical power. However, both the first and second loads 31 and 23 may be other types of loads capable of being driven by the gas turbine system 11 and the steam turbine 21. In addition, although the gas turbine system 11 and the steam turbine 21 drive separate loads (e.g., first and second loads 31 and 23) in the illustrated embodiment, the gas turbine system 11 and steam turbine 23 may also be utilized in tandem to drive a single load via a single shaft.

The system 10 further includes the HRSG system 27. Heated exhaust gas 29 from the turbine 18 is transported into the HRSG system 27 to heat water to produce steam 33 used to power the steam turbine 21. As will be appreciated, the HRSG system 27 may include various economizers, condensers, evaporators, heaters, and so forth, to generate and heat the steam 33 used to power the steam turbine 21. The steam 33 produced by the HRSG system 27 passes through turbine blades of the steam turbine 21. As the steam 33 pass through the turbine blades in the steam turbine 21, the steam turbine 21 is driven into rotation, which causes the shaft 27 to rotate, thereby powering the second load 23.

In the following discussion, reference may be made to various directions or axes, such as an axial direction 32 along the axis 25, a radial direction 34 away from the axis 25, and a circumferential direction 36 around the axis 25 of the steam turbine 21. Additionally, as mentioned above, while the mounting segments (e.g., a first dovetail portion of a dovetail joint) described below may be used with any of a variety of turbomachines (e.g., compressors 12, gas turbines 18, or steam turbines 21) the following discussion describes improved mounting segments (e.g., a first dovetail portion of a dovetail joint) in the context of the turbine 21 (e.g., a steam turbine).

Figure 2:
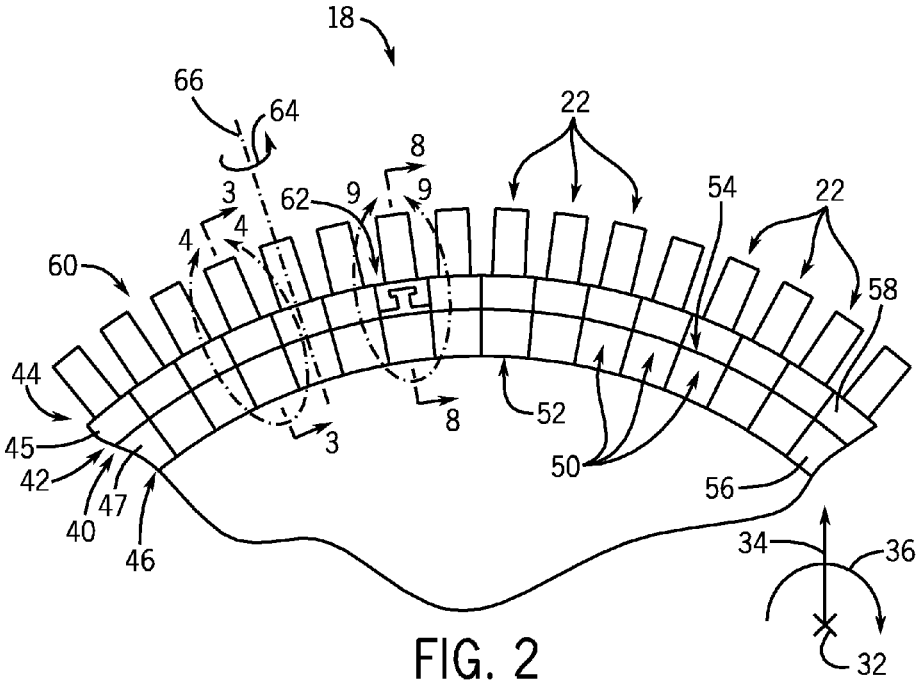
FIG. 2 is a partial cross-sectional axial view of a turbomachine, illustrating circumferentially mounted turbomachine blades having mounting segments, in accordance with embodiments of the present disclosure.

FIG. 2 is a partial cross-sectional axial view of the turbine 18 with the turbine blades 22 coupled to the rotor 24, illustrating mounting assemblies or joints 40 (e.g., dovetail joints 42), which couple the turbine blades 22 to the rotor 24. Each mounting joint 40 includes a first joint portion 44 (e.g., a first dovetail portion 45) disposed on each blade 22, and a second joint portion 46 (e.g., a second dovetail portion 47) disposed on the rotor 24. For example, the first joint portion 44 (e.g., first dovetail portion 45) may be a male joint portion (e.g., male dovetail portion) and the second joint portion 46 (e.g., second dovetail portion 47) may be a female joint portion (e.g., female dovetail portion), or vice versa. In the illustrated embodiment, the first joint portion 44 (e.g., dovetail portion 45) comprises a mounting segment 50 that is male, and the second joint portion 46 (e.g., dovetail portion 47) comprises a recess or slot 52 that is female. Specifically, the mounting segments 50 are partially disposed within the slot 52 (e.g., a circumferential slot) formed in an outer surface 54 of the rotor 24. For example, the slot 52 may extend in the circumferential direction 36 completely around (e.g., encircling) the rotor 24. As illustrated, a first portion 56 of each mounting segment 50 is disposed within the slot 52 of the rotor 24, while a second portion 58 of each mounting segment 50 extends radially 34 outward from the outer surface 54 of the rotor 24 and is coupled to the respective turbine blade 22.

The illustrated embodiment shows a single stage 60 of turbine blades 22 coupled to the rotor 24. As used herein, a "stage" of turbine blades 22 refers to those turbine blades 22 extending circumferentially 36 around the rotor 24 at a certain axial 32 location along the rotor 24. Additionally, as mentioned above, the mounting segments 50 in the illustrated embodiment are circumferentially 36 mounted in the slot 52. In other words, the slot 52 formed in the rotor 24 extends circumferentially 36 around the rotor 24. As will be appreciated, the mounting segments 50 and their respective turbine blades 22 may be coupled to the rotor 24 by inserting the mounting segments 50 into the slot 52. For example, as described in detail below, one or more of the mounting segments 50 may be installed by inserting the mounting segment 50 radially 34 into the slot 52 and subsequently twisting or rotating 64 the mounting segment 50 about its axis 66, thereby engaging the mounting segment 50 with retaining ledges of the slot 52 to secure the turbine blade 22 to the rotor 24. In this manner, the mounting segments 50 may be installed within the slot 52 without an assembly gate or other enlarged opening formed in the slot 52. In other words, the slot 52 may be uniform circumferentially 36 about the rotor 24 (e.g., constant width of opening into slot 52).

However, not all mounting segments 50 in the single stage 60 may be configured for radial 34 insertion and subsequent rotation 64. As shown, the mounting segments 50 disposed within the slot 52 of the rotor 24 abut one another in the circumferential direction 36. Specifically, each mounting segment 50 abuts the mounting segments 50 to which it is circumferentially 36 adjacent. As a result, once a certain number of mounting segments 50 of the single stage 60 are coupled to the rotor, there may not be adequate room for the radial 34 insertion and twisting 64 of additional mounting segments 50. For example, when all but one mounting segment 50 of the single stage 60 of turbine blades 22 have been radially 34 inserted into the slot 52, there may not be enough space or room to radially 34 insert and twist 64 the final mounting segment 50. Therefore, the single stage 60 of turbine blades 22 may include one or more mounting segments 50 (e.g., mounting segment 62) having a segmented or multi-piece configuration. As described in detail below, the multiple pieces of the mounting segment 50 having a multi-piece configuration (e.g., mounting segment 62) may be radially 34 inserted into the slot 52 individually, arranged within the slot 52 to engage with the retaining ledges of the slot 52, and coupled to one another. In this manner, the final mounting segment 50 of the single stage 60 (e.g., mounting segment 62) may be radially 34 installed within the slot 52 without an assembly gate or other enlarged opening in the slot 52. In other words, the slot 52 may be uniform circumferentially 36 about the rotor 24 (e.g., constant width of opening into slot 52).

Figure 3:
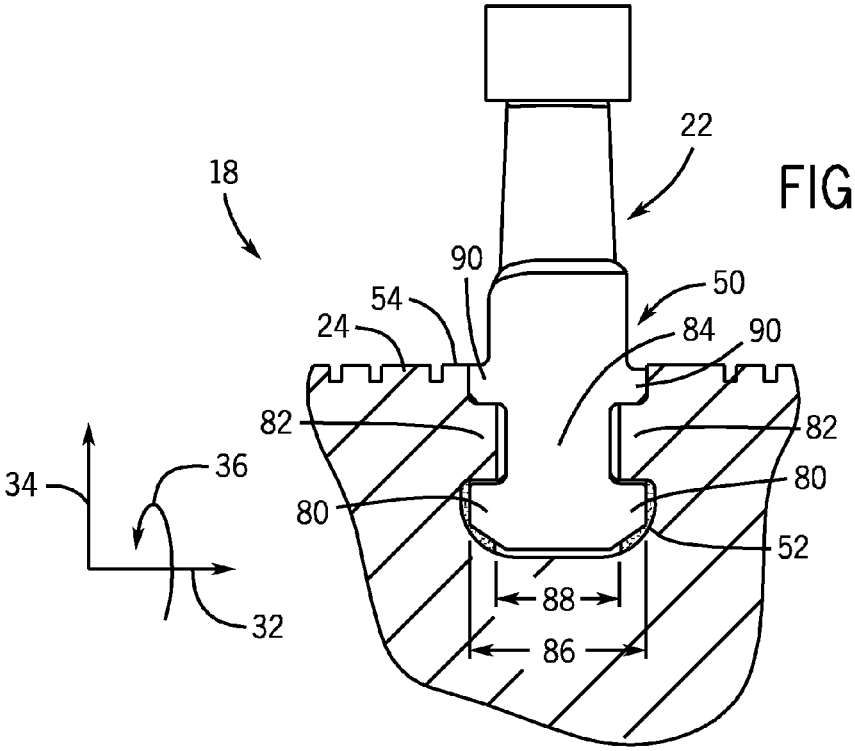
FIG. 3 is a partial cross-sectional circumferential view of a turbomachine, illustrating a circumferentially mounted turbomachine blade having a mounting segment, in accordance with embodiments of the present disclosure.

FIG. 3 is a partial cross-sectional circumferential view, taken along line 3-3 of FIG. 2, of the turbine 18, illustrating an embodiment of the turbine blade 22 and the mounting segment 50 circumferentially 36 mounted in the slot 52 around the rotor 24. In the illustrated embodiment, the mounting segment 50 and the turbine blade 22 may be integrally formed. In other words, the mounting segment 50 and the turbine blade 22 may be a single piece. Furthermore, the mounting segment 50 is configured to be inserted radially 34 into the slot 52 of the rotor 24 and subsequently twisted or rotated, thereby engaging opposite hooks 80 of the mounting segment 50 with opposite retaining ledges 82 of the slot 52. That is, the hooks 80 of the mounting segment 50 expand and radially 34 abut the retaining ledges 82 of the slot 52 after the mounting segment 50 is inserted radially 34 into the slot 52 and twisted or rotated within the slot 52. More specifically, in the installed position shown, the hooks 80 extend laterally from a neck 84 of the mounting segment 50 along the axial 32 direction of the turbine 18 and on opposite sides from one another. The hooks 80 and the neck 84 of the mounting segment 50 combine to have a width 86, while a width 88 extends between the retaining ledges 82 of the slot 52. As the width 88 is less than the width 86, the hooks 80 cause the mounting segment 50 to be radially 34 retained within the slot 52, thereby securing the mounting segment 50 and the turbine blade 22 to the rotor 24.

In the illustrated embodiment, the mounting segment 50 further includes anti-rotation ridges 90. Specifically, the anti-rotation ridges 90 extend laterally from the neck 84 and on opposite sides of the mounting segment 50. As shown, the anti-rotation ridges 90 are configured to be disposed within the slot 52 of the rotor 24 and are generally flush with the outer surface 54 of the rotor 24 when the mounting segment 50 is coupled to the rotor 24. As will be appreciated, the anti-rotation ridges 90 may reduce rotation or pivoting of the mounting segment 50 within the rotor 24, thereby increasing the stability and rigidity of the turbine blade 22. In certain embodiments, the mounting segment 50 may not include anti-rotation ridges 90.

Figure 4:
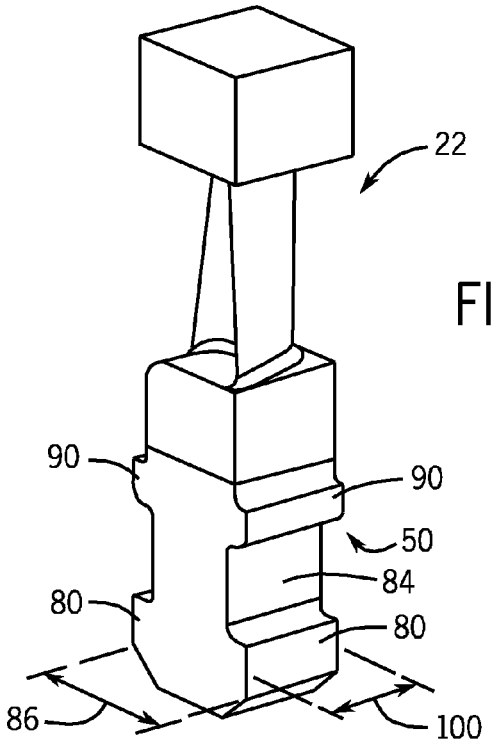
FIG. 4 is a perspective view of a turbomachine blade having a mounting segment, in accordance with embodiments of the present disclosure.

FIG. 4 is a perspective view, taken within line 4-4 of FIG. 2, of the turbine blade 22 and the mounting segment 50 having a single piece construction, where the mounting segment 50 is configured to be coupled to the rotor 24 by radially 34 inserting the mounting segment 50 into the slot 52 of the rotor 24 and rotating or twisting the mounting segment 50 within the slot 52. As shown, the mounting segment 50 has a depth 100, which is less than the width 88 (FIG. 3) between the retaining ledges 82 of the slot 52 in the rotor 24. In this manner, the mounting segment 50 may be radially 34 inserted into the slot 52 by orienting the segment 50 with the depth 100 between the retaining ledges 82 of the slot 52. Thereafter, as described below, the mounting segment 50 may be rotated or twisted approximately 90 degrees within the slot 52, thereby causing the hooks 80 of the mounting segment 50 to abut the retaining ledges 82 of the slot 52 (e.g., by orienting the segment 50 with the width 86 below the ledges 82). In this manner, the mounting segment 50 may be secured within the slot 52 and the turbine blade 22 may be coupled to the rotor 24 without any assembly gate (e.g., enlarged opening in the slot 52).

Figure 5:
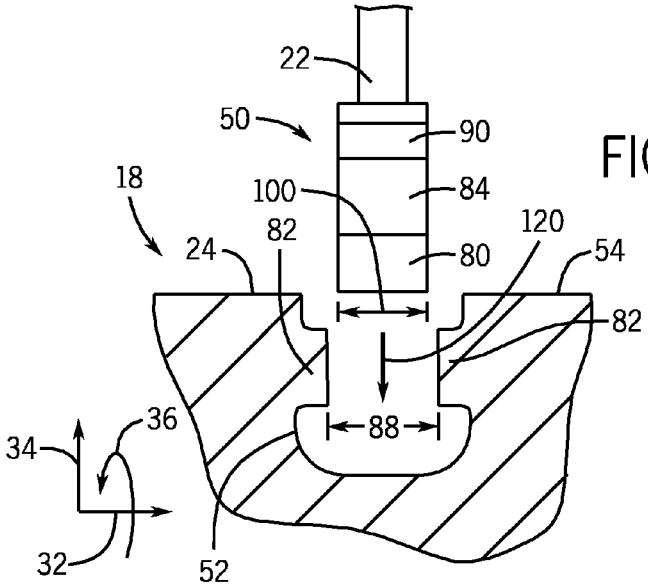
FIG. 5 is a partial cross-sectional circumferential view of a turbomachine, illustrating installation of a turbomachine blade having a mounting segment, in accordance with embodiments of the present disclosure.
Figure 6:
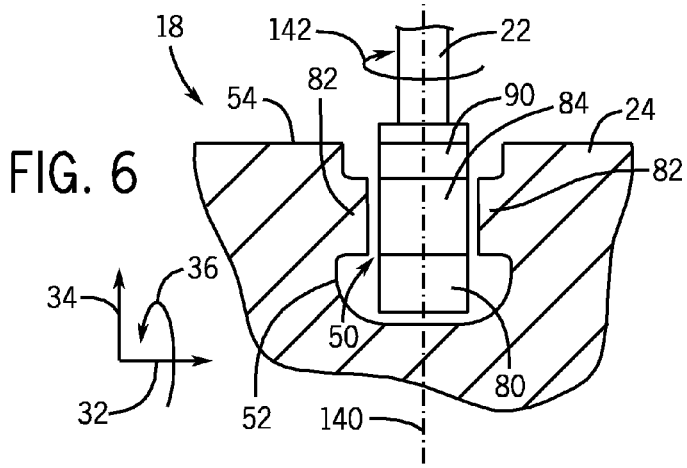
FIG. 6 is a partial cross-sectional circumferential view of a turbomachine, illustrating installation of a turbomachine blade having a mounting segment, in accordance with embodiments of the present disclosure.
Figure 7:
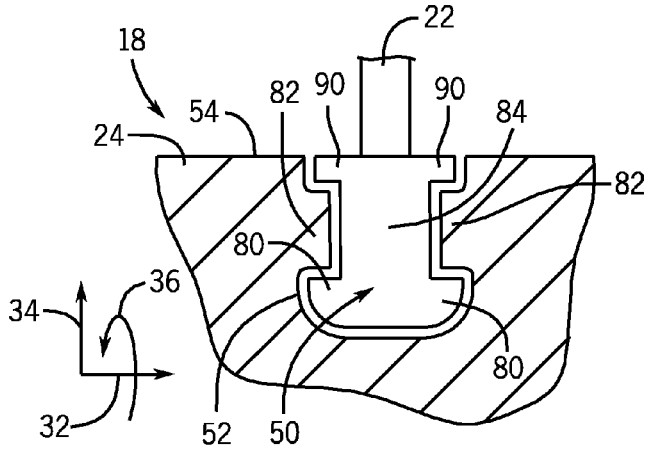
FIG. 7 is a partial cross-sectional circumferential view of a turbomachine, illustrating installation of a turbomachine blade having a mounting segment, in accordance with embodiments of the present disclosure.

FIGS. 5-7 are schematics of the turbine blade 22 and the mounting segment 50, illustrating the installation of the mounting segment 50 by radially 34 inserting the mounting segment 50 into the slot 52 of the rotor 24 and rotating or twisting the mounting segment 50 within the slot 52. For example, FIG. 5 illustrates the manner in which the mounting segment 50 may be radially 34 inserted into the slot 52 of the rotor 24. Specifically, in the illustrated configuration (e.g., a first configuration) of the mounting segment 50, the depth 100 of the mounting segment 50 is less than the width between the retaining ledges 82 of the slot 52. Therefore, in the manner illustrated, the mounting segment 50 may be radially 34 inserted into the slot 52 in the radial 34 direction, as indicated by arrow 120. In this way, the mounting segment 50 may be radially 34 inserted into the slot 52 between the retaining ledges 82 of the slot 52 without any assembly gate (e.g., enlarged opening in the slot 52).

Once the mounting segment 50 has been radially 34 inserted into the slot 52 of the rotor 24, the mounting segment 50 may be rotated or twisted within the slot 52, as illustrated by FIG. 6. More particularly, the mounting segment 50 may be rotated or twisted about a longitudinal axis 140 of the mounting segment 50, as indicated by arrow 142, from the configuration shown in FIG. 5 (e.g., a first configuration) to the configuration shown in FIG. 7 (e.g., a second configuration). Furthermore, the mounting segment 50 may be rotated or twisted approximately 90 degrees. In this manner, the hooks 80 of the mounting segment 50 may rotate (e.g., expand) within the slot 52 and beneath the retaining ledges 82. Once the mounting segment 50 has been rotated about the longitudinal axis 140 approximately 90 degrees, the hooks 80 of the mounting segment 50 engage with, and radially 34 abut, the retaining ledges 82 of the slot 52, as shown in FIG. 7. In this manner, the mounting segment 50 may be secured within the slot 52, as the interface between the retaining ledges 82 and the hooks 80 of the mounting segment 50 blocks movement (e.g., movement in the radial 34 direction) of the mounting segment 50, thereby securing the turbine blade 22 to the rotor 24. Again, this radial 34 insertion and twisting 142 technique eliminates the need for an assembly gate, while also enabling installation of each blade 22 very close to its desired circumferential 36 position along the slot 52, e.g., without requiring the blade to be moved circumferentially 36 along the slot 52 from an assembly gate to its desired circumferential position.

Figure 8:
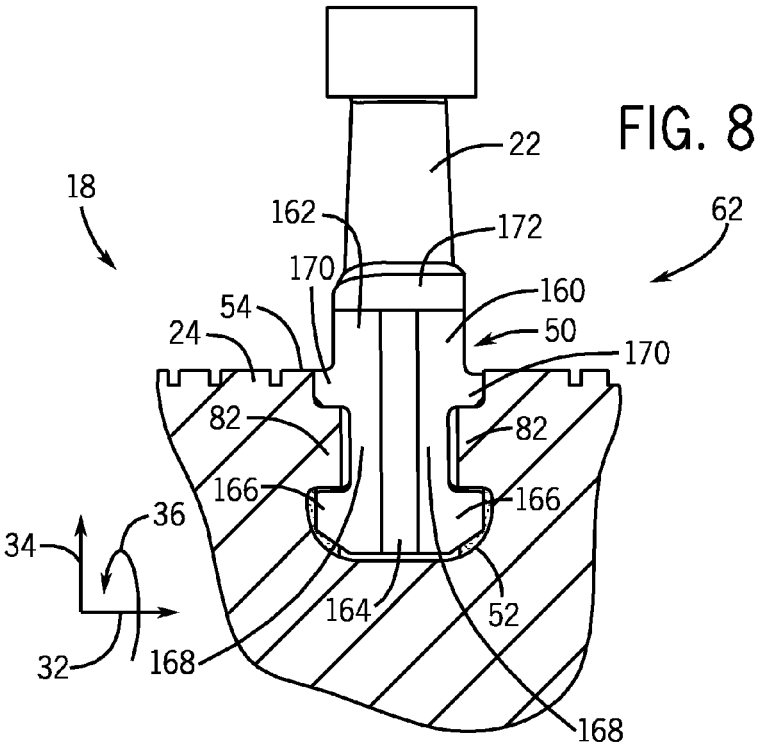
FIG. 8 is a partial cross-sectional circumferential view of a turbomachine, illustrating installation of a turbomachine blade having a multi-piece mounting segment, in accordance with embodiments of the present disclosure.

FIG. 8 is a partial cross-sectional circumferential view, taken within line 8-8 of FIG. 2, of the turbine 18, illustrating an embodiment of the turbine blade 22 and the mounting segment 50 circumferentially 36 mounted to the rotor 24. In the illustrated embodiment, the mounting segment 50 has a multi-piece, or segmented, construction. In this manner, the mounting segment 50 may be installed in the slot 52 of the rotor 24 by inserting the multiple pieces individually and one at a time. For example, the assembled mounting segment 50 shown in FIG. 8 includes a first dovetail segment 160 (e.g., a forward or "gas/steam exit side" dovetail segment), a second dovetail segment 162 (e.g., a trailing or "gas/steam entrance side" dovetail segment), and a captured spreader piece 164. As shown, in the assembled configuration, the captured spreader piece 164 is disposed between, or "captured" by, the first and second dovetail segments 160 and 162. In one embodiment, the captured spreader piece 164 may be a rectangular plate. Additionally, in certain embodiments, the first and second dovetail segments 160 and 162 may have identical or similar configurations. For example, both the first and second dovetail segments 160 and 162 include a hook 166 extending laterally from a respective neck 168 of the first and second dovetail segments 160 and 162. As similarly discussed above, the hooks 166 of the first and second dovetail segments 160 and 162 are configured to engage with one of the retaining ledges 82 of the slot 52. Additionally, the first and second dovetail segments 160 and 162 also include an anti-rotation ridge 170 extending laterally from their respective necks 168. As similarly discussed above, the anti-rotation ridges 170 are configured to be disposed within the slot 52 of the rotor 24 and are generally flush with the outer surface 54 of the rotor 24 when the first and second dovetail segments 160 and 162 are coupled to the rotor 24. The anti-rotation ridges 170 may reduce rotation or pivoting of the mounting segment 50 within the rotor 24, thereby increasing the stability and rigidity of the turbine blade 22.

The mounting segment 50 in the illustrated embodiment further includes a cover portion 172, which is integrated with the turbine blade 22. In other embodiments, the cover portion 172 may not be integrated with the turbine blade 22. As discussed in detail below, the cover portion 172 is configured to engage with the first and second dovetail segments 160 and 162, thereby holding the first dovetail segment 160, the second dovetail segment 162, and the captured spreader piece 164 between the first and second dovetail segments 160 and 162 in place within the slot 52 of the rotor 24. Specifically, once the first and second dovetail segments 160 and 162 and the captured spreader piece 164 are installed within the slot 52 of the rotor 24, the cover portion 172 may be coupled to the first and second dovetail segments 160 and 162, thereby securing the multiple pieces of the mounting segment 50 together and completing the installation of the mounting segment 50 and the turbine blade 22 with the rotor 24. Again, this multi-piece construction of the final mounting segment 50 (e.g., 62) enables installation of the final blade 22 without any assembly gate (e.g., enlarged opening) in the slot 52.

Figure 9:
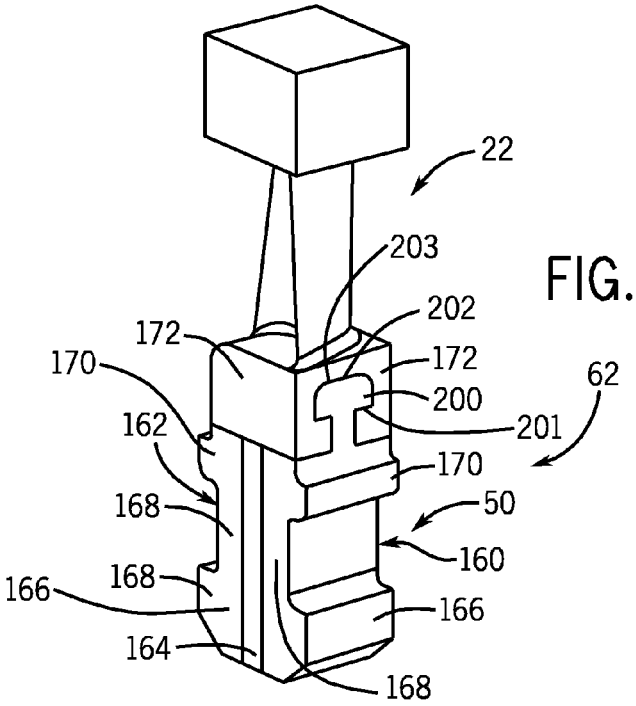
FIG. 9 is a partial perspective view of a turbomachine blade having a multi-piece mounting segment, in accordance with embodiments of the present disclosure.

FIG. 9 is a perspective view, taken within line 9-9 of FIG. 2, of the turbine blade 22 and the mounting segment 50 having a multi-piece, or segmented, construction, where the mounting segment 50 is configured to be coupled to the rotor 24 by individually inserting the multiple pieces of mounting segment 50 radially 34 into the slot 52 of the rotor 24. As mentioned above, the first and second dovetail segments 160 and 162 are configured to engage with the cover portion 172, thereby securing the multiple components of the mounting segment 50 in the configuration shown below. Specifically, each of the first and second dovetail segments 160 and 162 have a rail 200 configured to engage with a retaining track or recess 202 of the cover portion 172. In the illustrated embodiment, the rail 200 has a T-shaped protrusion 201, which is received by, and engaged with, a T-shaped groove 203 of the retaining track 202 in the cover portion 172. However, in other embodiments, the rail 200 and track 202 may have other geometries or configurations. As will be appreciated, the retaining track 202 is configured to match the geometry of the rail 200, such that the rail 200 and the retaining track 202 interlock and block movement (e.g., radial 34 and circumferential 36) of the components of the mounting segment 50. In this manner, the mounting segment 50 may be secured within the slot 52, and the turbine blade 22 may be coupled to the rotor 24. Furthermore, in other embodiments, the captured spreader piece 164 may also have the rail 200 configured to engage with the retaining track 202.

Figure 10:
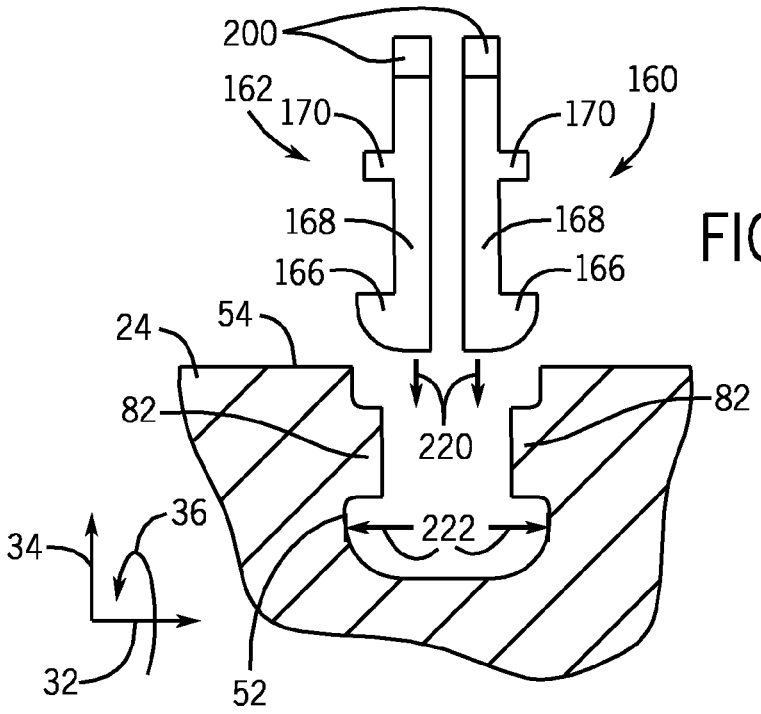
FIG. 10 is a partial cross-sectional circumferential view of a turbomachine, illustrating installation of a turbomachine blade having a multi-piece mounting segment, in accordance with embodiments of the present disclosure.

FIGS. 10-13 are schematics of the turbine blade 22 and the mounting segment 50, illustrating the installation of the mounting segment 50 by radially 34 inserting the multiple components of the mounting segment 50 (e.g., the first and second dovetail segments 160 and 102 and the captured spreader piece 164) into the slot 52 of the rotor 24 individually. Thereafter, the cover portion 172, which may be integrated with the turbine blade 22, may be coupled to the multiple components of the mounting segment 50, thereby securing the mounting segment 50 within the slot 52 of the rotor 24. For example, FIG. 10 illustrates the manner in which the first and second dovetail segments 160 and 102 of the mounting segment 50 may be radially 34 inserted into the slot 52 of the rotor 24. Specifically, in the manner illustrated, the first and second dovetail segments 160 and 162 may be inserted into the slot 52 in the radial 34 direction, as indicated by arrows 220. In the illustrated configuration (e.g., a first configuration), with the spreader piece 164 absent, the dovetail portions 160 and 162 (alone or together) are narrower than the width 88 between the opposite ledges 82.

Once the first and second dovetail segments 160 and 162 have been inserted into the slot 52 of the rotor, the first and second dovetail segments 160 and 162 may be positioned (e.g., expanded) to be engaged with the retaining ledges 82 of the slot 52. Specifically, as indicated by arrows 222, the first and second dovetail portions 160 and 162 may be moved in opposite axial 32 directions (e.g., an upstream axial 32 direction and a downstream axial 32 direction), such that the hook 166 each dovetail portion 160 or 162 engages with a respective retaining ledge 82 of the slot 52.

Figure 11:
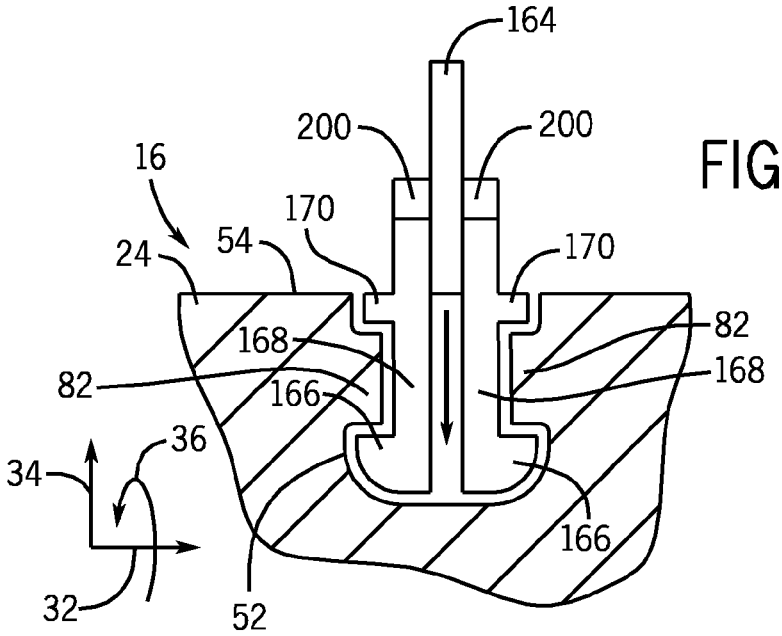
FIG. 11 is a partial cross-sectional circumferential view of a turbomachine, illustrating installation of a turbomachine blade having a multi-piece mounting segment, in accordance with embodiments of the present disclosure.

FIG. 11 illustrates the manner in which the captured spreader piece 164 of the mounting segment 50 may be positioned within the slot 52 of the rotor 24. More specifically, after the first and second dovetail segments 160 and 162 are disposed within the slot 52 and engaged with respective retaining ledges 82, the captured spreader piece 164 may be radially 34 inserted into the slot 52 between the first and second dovetail segments 160 and 162. In this manner, the captured spreader piece 164 may help outwardly bias and hold the first and second dovetail segments 160 and 162 in position (e.g., in a second configuration), whereby the respective hooks 166 of the first and second dovetail segments 160 and 162 are engaged with respective retaining ledges 82 of the slot 52 of the rotor 24.

Figure 12:
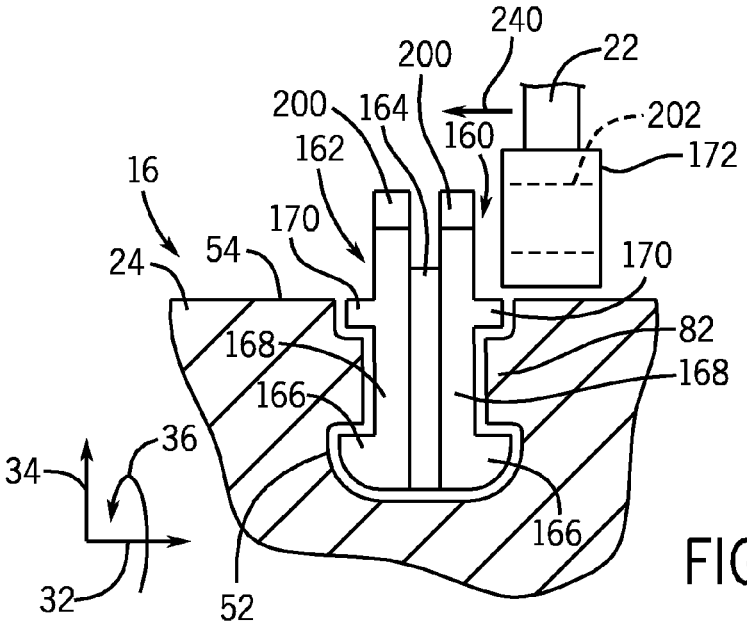
FIG. 12 is a partial cross-sectional circumferential view of a turbomachine, illustrating installation of a turbomachine blade having a multi-piece mounting segment, in accordance with embodiments of the present disclosure.
Figure 13:
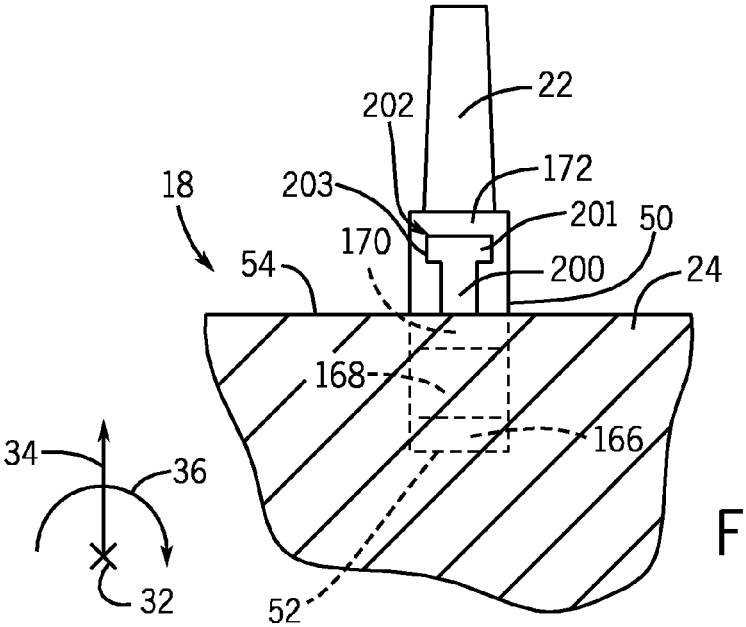
FIG. 13 is a partial axial view of a turbomachine, illustrating installation of a turbomachine blade having a multi-piece mounting segment, in accordance with embodiments of the present disclosure.

FIG. 12 illustrates the manner in which the cover portion 172 of the mounting segment 50 may be coupled to the first and second dovetail segments 160 and 162. As discussed above, the first and second dovetail segments 160 and 162 have the rails 200 (e.g., T-shaped protrusions 201), which are configured to engage with the retaining track 202 (e.g., T-shaped groove 203) of the cover portion 172 of the mounting segment 50. For example, in the illustrated embodiment, the cover portion 172, which is integrated with the turbine blade 22, may be translated in the axial 32 direction, as indicated by arrow 240. In this manner, the retaining track 202 of the cover portion 172 may be positioned about, and engaged with, the rails 200 of the first and second dovetail segments 160 and 162, thereby securing the cover portion 172 to the first and second dovetail segments 160 and 162. As a result, the components of the mounting segment 50 (e.g., the first and second dovetail segments 160 and 162, the captured spreader piece 164, and the cover portion 172) may be held in place, and the mounting segment 50 of the turbine blade 22 may be assembled and coupled to the rotor 24. For example, FIG. 13 is a partial cross-sectional axial view of the turbine 16, illustrating the turbine blade 22 coupled to the rotor 24 by the mounting segment 50 having a multi-piece or segmented configuration.

The disclosed embodiments are directed towards improved mounting segments 50, which may couple turbomachine blades (e.g., turbine blades 22) to a turbomachine rotor or drum (e.g., rotor 24) without the use of an assembly gate (e.g., enlarged opening in circumferential slot 52). In other words, the disclosed embodiments may be used with a uniform circumferential slot 52, which has a cross-section that is constant in the circumferential direction 36 about the rotor 24. For example, the mounting segment 50 may be configured to insert radially 34 into the retaining slot 52 of the rotor 24, and then subsequently rotate within the slot 52 at any position along the slot 52. Upon rotation of the mounting segment 50, hooks 80 of the mounting segment 50 may engage with retaining ledges 82 of the slot 52, thereby securing the mounting segment 50 within the slot 52. In other embodiments, the mounting segment 50 may have a segmented or multi-piece configuration, which enables mounting of the blade 22 at any position along the slot 52 without any assembly gate (e.g., enlarged opening) in the slot 52. For example, multiple pieces (e.g., first and second dovetail segments 160 and 162 and captured spreader piece 164) of the mounting segment 50 may be inserted into the slot 50 of the rotor 24 individually. Furthermore, the multiple pieces of the mounting segment 50 (e.g., first and second dovetail segments 160 and 162 and captured spreader piece 164) may be coupled to the cover portion 172 of the mounting segment 50, once the multiple pieces of the mounting segment 50 are positioned within the slot 52 of the rotor 24. Moreover, while the embodiments discussed above are described in the context of a turbine 21 (e.g., a steam turbine), it is important to note that the disclosed mounting segments 50 may be used with other turbomachines, such as compressors.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a turbomachine rotor comprising a slot; and a turbomachine blade mounting segment having first and second configurations, wherein the first configuration is configured to tangentially insert in a radial direction into the slot of the turbomachine rotor, and the second configuration is configured to expand relative to the first configuration to retain the turbomachine blade mounting segment in the slot, wherein the turbomachine blade mounting segment comprises a first dovetail segment, a second dovetail segment, a captured spreader piece, and a cover portion having a retention feature, the cover portion is configured to couple the first dovetail segment, the second dovetail segment, and the captured spreader piece to one another, and the first dovetail segment, the second dovetail segment, and the captured spreader piece are each configured to be individually inserted in the radial direction into the slot, and at least one portion of the turbomachine blade mounting segment is integrally formed with a turbomachine blade configured to be coupled to the turbomachine rotor by the turbomachine blade mounting segment.

2. The system of claim 1, wherein the first and second dovetail segments each comprise hooks configured to pass between retaining ledges of the slot during insertion into the slot in the first configuration, and the hooks are configured to move into engagement with the retaining ledges of the slot in the second configuration.

3. The system of claim 2, wherein the first configuration has first opposite sides configured to fit between the retaining ledges of the slot, the second configuration has second opposite sides with the hooks configured to overlap with the retaining ledges, the first and second opposite sides are oriented approximately 90 degrees relative to one another, and the second configuration is rotated approximately 90 degrees relative to the first configuration in the slot.

4. The system of claim 1, comprising the turbomachine blade, and a turbomachine having the turbomachine rotor.

5. A system, comprising:

a first turbomachine blade mounting segment configured to couple only a first turbomachine blade to a turbomachine rotor; and a second turbomachine blade mounting segment configured to couple only a second turbomachine blade to the turbomachine rotor, wherein the first and second turbomachine blade mounting segments are configured to tangentially insert in a radial direction into a slot of the turbomachine rotor, and then expand in the slot, wherein the second turbomachine blade mounting segment comprises a first dovetail segment, a second dovetail segment, a spreader piece, and a cover portion having a retention feature, wherein the cover portion is configured to couple the first dovetail segment, the second dovetail segment, and the spreader piece to one another, wherein the first dovetail segment, the second dovetail segment, and the spreader piece are individually insertable in the radial direction into the slot of the turbomachine rotor to expand the second turbomachine blade mounting segment in the slot.

6. The system of claim 5, wherein the first turbomachine blade mounting segment is configured to insert in the radial direction into the slot of the turbomachine rotor and then rotate about its axis to expand the first turbomachine blade mounting segment in the slot.

* * * * *